US009034253B2

(12) United States Patent
Geissler

(10) Patent No.: US 9,034,253 B2
(45) Date of Patent: May 19, 2015

(54) METHOD AND DEVICE FOR SANITIZING PACKAGINGS

(75) Inventor: Hanno Geissler, Krefeld (DE)

(73) Assignee: SIG TECHNOLOGY AG, Neuhausen am Rheinfall (CH)

( * ) Notice: Subject to any disclaimer, the term of this patent is extended or adjusted under 35 U.S.C. 154(b) by 725 days.

(21) Appl. No.: 13/376,785

(22) PCT Filed: Jun. 4, 2010

(86) PCT No.: PCT/DE2010/000653

§ 371 (c)(1),
(2), (4) Date: Dec. 7, 2011

(87) PCT Pub. No.: WO2010/142278

PCT Pub. Date: Dec. 16, 2010

(65) Prior Publication Data

US 2012/0076688 A1 Mar. 29, 2012

(30) Foreign Application Priority Data

Jun. 8, 2009 (DE) ..... 10 2009 029 706

(51) Int. Cl.

| | |
|---|---|
| ***A61L 2/16*** | (2006.01) |
| ***B65B 55/10*** | (2006.01) |
| ***B65B 3/00*** | (2006.01) |
| ***B65B 43/26*** | (2006.01) |
| ***B65B 51/14*** | (2006.01) |

(52) U.S. Cl.

CPC . *B65B 55/10* (2013.01); *B65B 3/00* (2013.01); *B65B 43/265* (2013.01); *B65B 51/144* (2013.01)

(58) Field of Classification Search

CPC ..... A61L 2/16; A61L 2/18; A61L 2/20
USPC ..... 422/28, 292
See application file for complete search history.

(56) References Cited

U.S. PATENT DOCUMENTS

| | | | | |
|---|---|---|---|---|
| 3,087,209 | A * | 4/1963 | Monk | 422/304 |
| 4,992,247 | A | 2/1991 | Foti | |
| 5,843,374 | A * | 12/1998 | Sizer et al. | 422/24 |
| 6,058,678 | A | 5/2000 | Lees | |
| 6,120,730 | A | 9/2000 | Palaniappan et al. | |
| 2002/0070358 | A1 * | 6/2002 | Thingelstad | 250/496.1 |

FOREIGN PATENT DOCUMENTS

| | | | |
|---|---|---|---|
| EP | 1197432 | A | 4/2002 |

* cited by examiner

*Primary Examiner* — Sean E Conley
(74) *Attorney, Agent, or Firm* — Lucas & Mercanti, LLP; Klaus P. Stoffel

(57) ABSTRACT

The method and the apparatus serve for disinfecting packaging formed at least in part as packaging sleeves closed all the way around. A disinfectant is applied to the packaging. The packaging sleeves are opened in a longitudinal direction of the sleeve in the region of both ends during the disinfection process and are transported through a disinfection tunnel. The disinfectant is applied to the packaging sleeves inside the disinfection tunnel. Along the disinfection tunnel, disinfectant flowing out of an opened end section of a packaging sleeve is introduced into an opened end section of an adjoining packaging sleeve.

9 Claims, 6 Drawing Sheets

METHOD AND DEVICE FOR SANITIZING PACKAGINGS

The present application is a 371 of International application PCT/DE2010/000653 filed Jun. 4, 2010, which claims priority of DE 10 2009 029 706.5, filed Jun. 8, 2009, the priority of these applications is hereby claimed and these applications are incorporated herein by reference.

BACKGROUND OF THE INVENTION

The invention relates to a method for disinfecting packaging formed at least in part as packaging sleeves closed all the way around, in which method a disinfectant is applied to the packaging.

The invention furthermore relates to an apparatus for disinfecting packaging formed at least in part as packaging sleeves closed all the way around, which apparatus has a supply device for a disinfectant to be applied to the packaging sleeves.

Such methods and apparatuses are used for disinfecting and more particularly for sterilizing packaging as well. Packaging produced from laminate-type materials with a region already closed at one side and an open region opposing it is often supplied to an appropriate disinfection and subsequently to a filling. The basic principle of the disinfection thus is similar to a disinfection of bottle-shaped containers, except for the fact that the disinfectant is introduced into the cavity of the packaging not via a still open aperture region but via a region still open on one side.

An effective disinfection generally requires the insertion of a tube-like supply device into the cavity of the packaging or the blowing of the disinfectant into the cavity in order to ensure an even and intensive contact of all inner wall regions with the disinfectant. Thus either incremental operation with an insertion and retraction of the supply members or the use of supply members moving in the transport direction is necessary in continuous operation.

SUMMARY OF THE INVENTION

An object of the present invention is to improve a method of the type mentioned at the outset such that an effective disinfection is supported at high throughput rates.

According to the invention, this object is achieved by virtue of the fact that the packaging sleeves opened in a longitudinal direction of the sleeve in the region of both ends are transported through a disinfection tunnel, within which the disinfectant is applied to the packaging sleeves and that, along the disinfection tunnel, disinfectant flowing out of an opened end section of a packaging sleeve is guided into an opened end section of an adjoining packaging sleeve.

A further object of the present invention is to manufacture an apparatus of the type mentioned at the outset such that a high-quality disinfection is supported at high throughput rates and/or that a reduction in the amount of utilized disinfectant is achieved at low throughput rates.

According to the invention, this object is achieved by virtue of the fact that a disinfection tunnel is provided with a transport device for the packaging sleeves and is designed for transporting the packaging sleeves with ends open in a longitudinal direction of the sleeve, that the supply device is arranged in the region of the disinfection tunnel and that arranged in the region of the disinfection tunnel there is at least one deflection for guiding the flow of the disinfectant out of an opened end section of a packaging sleeve and into an opened end section of an adjoining packaging sleeve.

Disinfecting the packaging sleeves when both end sections are in an open state allows an even and intensive through-flow of disinfectant to be ensured without the necessity of inserting a supply member into the cavity of the packaging. Moreover, it is possible for a flow of the disinfectant to be guided in an approximately snaking fashion through plurality of packaging sleeves arranged in succession and so an effective use of the utilized disinfectant is ensured.

In particular, the use of the deflections also makes it possible to prescribe that the packaging sleeves are exposed to the disinfectant for a long period of time. The combination of the deflections and the disinfection tunnel allows the same disinfectant in each case to be applied a number of times to the packaging sleeves and thus allows a corresponding multiplication of the exposure time of a certain amount of the disinfectant.

A compact arrangement is supported by virtue of the fact that the disinfectant is transferred from one packaging sleeve to the adjoining packaging sleeve along a U-like flow path.

A very simple apparatus design can be achieved by virtue of the fact that the packaging sleeves are moved past fixedly arranged deflections.

A significant aspect of the invention also consists in ensuring a loss-free transfer of the disinfectant when empty spaces occur within the row of successive packaging sleeves.

Corresponding empty spaces can occur, for example, as a result of malfunctions during folding of the packaging sleeves or as a result of quality control and subsequent sorting out of damaged packaging sleeves.

High throughput rates are supported by the fact that the packaging sleeves are transported continuously.

According to a different embodiment, it is also possible for the packaging sleeves to be transported incrementally.

The sterilization of differently designed packaging sleeves is supported by the fact that the deflections are positioned in the region of the disinfection tunnel such that they can be positioned and/or interchanged. The interchangeable arrangement of the deflections in particular allows an effective disinfection of different packaging formats. Here, the formats can vary in respect of the length and/or the cross-sectional design.

Low consumption rates of the disinfectant and low energy use can be supported by the fact that at least part of the disinfectant is circulated within a return system.

DETAILED DESCRIPTION OF THE INVENTION

Figure 1:
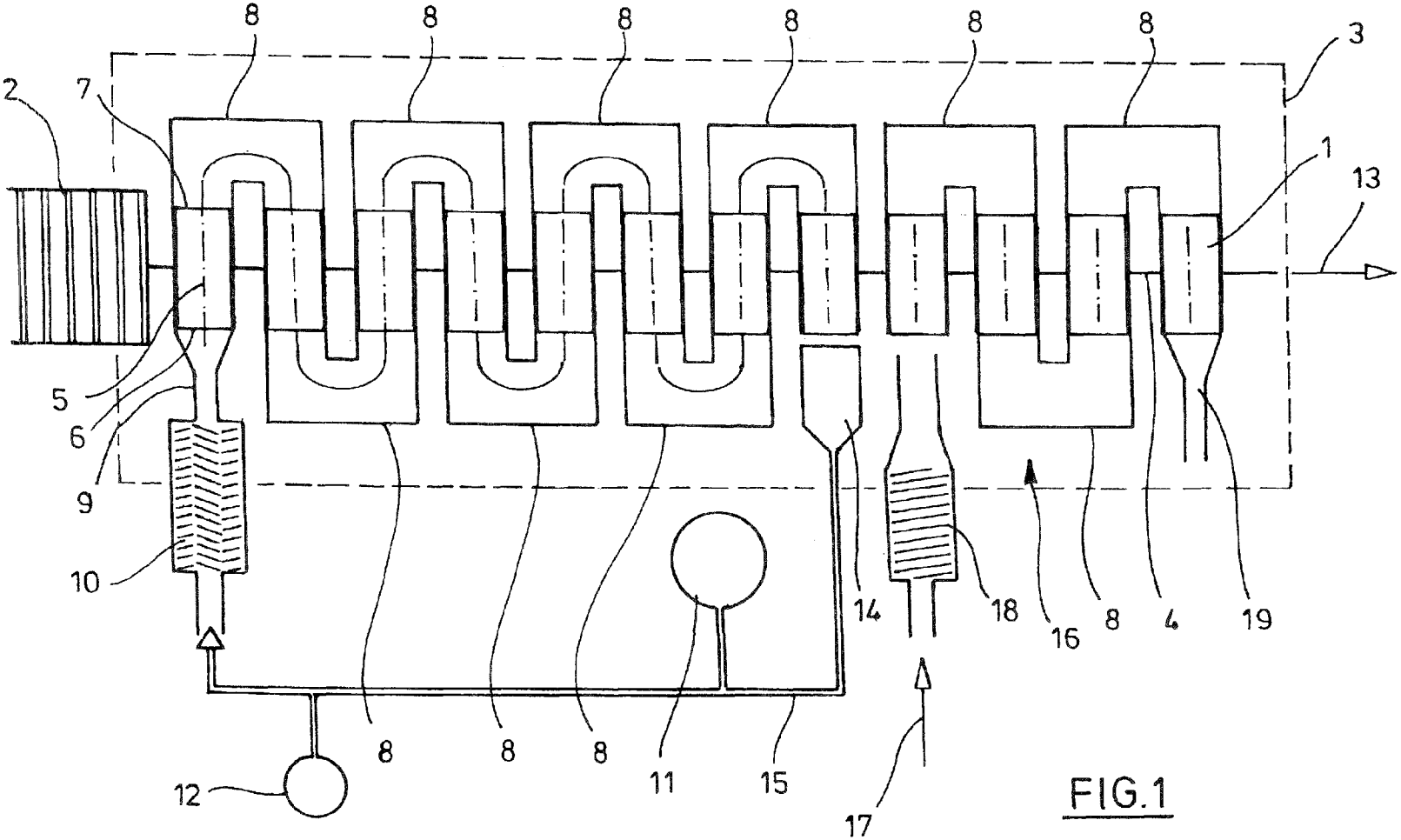
FIG. 1 shows a schematic side view of a disinfection tunnel with a multiplicity of U-shaped deflection elements for the disinfectant.

FIG. 1 shows a schematic side view of an apparatus for disinfecting packaging sleeves (1). The packaging sleeves (1) are transported into the region of the disinfectant apparatus by a supply (2) and are unfolded prior to the disinfection thereof. A transport device (4) is arranged in the region of a disinfection tunnel (3), which transport device can be implemented as, for example, a circulating chain.

The packaging sleeves (1) have an open design in the region of ends (6, 7) opposing one another in a longitudinal direction (5) of the sleeve. The packaging sleeves (1) have a closed design in an encircling direction with respect to the longitudinal direction (5) of the sleeve and thereby provide a tube-like basic structure.

Deflections (8) are arranged respectively facing the ends (6, 7) in the region of the disinfection tunnel (3). The deflections (8) extend in a substantially U-shaped fashion and provide flow channels for a disinfectant. The disinfection tunnel (3) moreover has a supply device (9) for the disinfectant. A heater (10) can be arranged in the region of the supply device (9).

The disinfectant, for example a mixture of hydrogen peroxide and air, is removed from a store (11) and is guided into the region of the supply device (9) through the heater (10). If need be, a sensor (12) can be provided for monitoring a composition of the mixture of air and disinfectant. From the supply device (9), the disinfectant flows into the opened end (6) of the first packaging sleeve (1) in a transport direction (13) and escapes from said packaging sleeve in the region of the end (7) opposite to said opened end. Here, the disinfectant then flows into the first deflection (8) and is guided by this deflection (8) into the adjoining open end (7) of the subsequent packaging sleeve (1) in the transport direction (13). This process is repeated in respect of all packaging sleeves (1) successively arranged in the transport direction (13) until the disinfectant reaches the region of a collection device (14), from where it is guided into the region of a return (15) in order to be provided for another use.

As an alternative to the flow direction of the disinfectant in the region of the disinfection tunnel (3) with a component oriented in the transport direction (13) illustrated in FIG. 1, it is likewise possible for the positions of the supply device (9) and the collection device (14) to be interchanged and for a flow component of the disinfectant to be implemented that counters the transport direction (13).

A drying device (16) is arranged downstream of the collection device (14) in the transport direction (13), with sterile air (17) typically being supplied to a heater (18) in the region thereof, which sterile air is then guided through the open packaging sleeves (1). The sterile air (17) for drying can also be successively guided through a plurality of packaging sleeves (1) open on both sides with the use of deflections (8) and it flows into the surroundings in the region of a collection device (19) or is supplied to be used again.

The transport device (4) can be operated in a continuous or incremental fashion.

Figure 2:
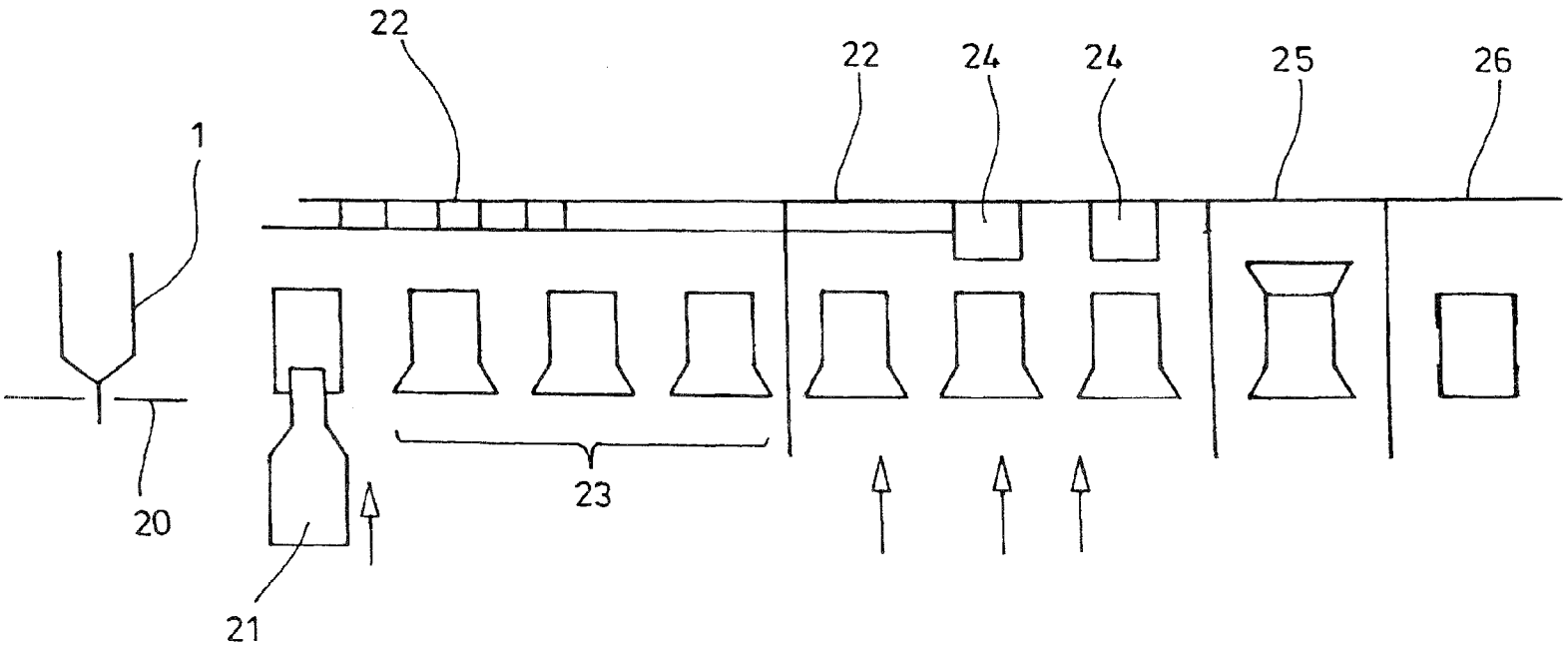
FIG. 2 shows a schematic illustration of a device for sealing the base, filling and end-sealing.

FIG. 2 shows the system component for further processing of the disinfected packaging sleeves (1). A sealing station (20) is arranged downstream of the drying device (16) illustrated in FIG. 1 and it seals one of the ends (6, 7) of the packaging sleeves (1). By way of example, the base can be sealed here. Using a heat-sealing head (21), there is final processing of the closed-off region whilst at the same time sterile air is supplied via a sterile air supply (22). After passing though a stop-phase (23) for achieving sufficient material stability, there is filling-up in the region of a filling station (24) whilst more sterile air is supplied.

The second end (6, 7) is then sealed in a final processing step, for example as a gable seal. Maintaining the precise predetermined contours of the packaging can be ensured by the final application of a shaping device (25).

The aforementioned processing steps described with respect to the example of the disinfection can be implemented for achieving arbitrary degrees of disinfection and/or for carrying out sterilization.

Figure 3:
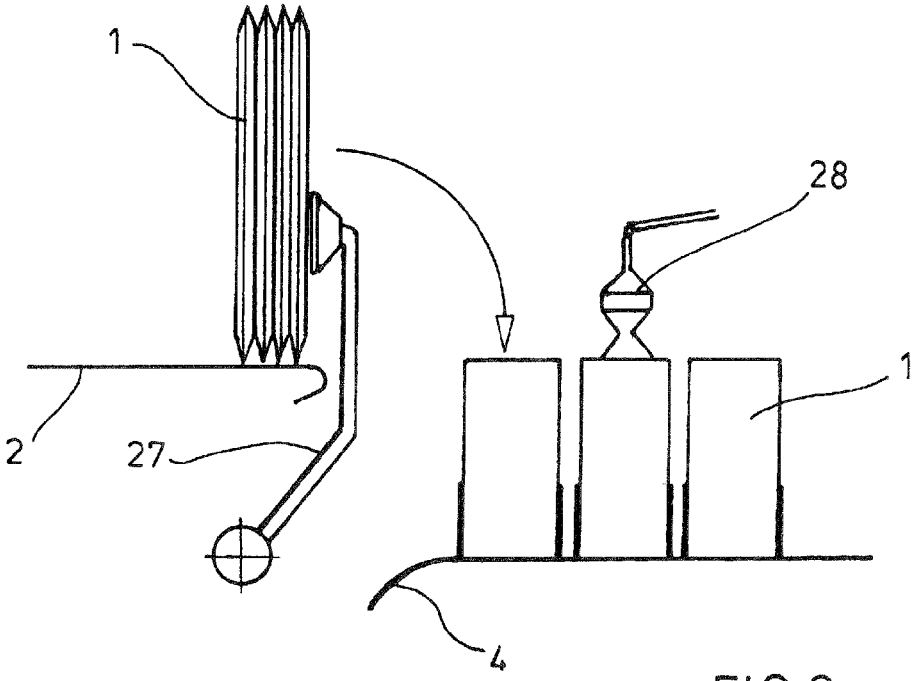
FIG. 3 shows a schematic illustration for demonstrating folding of the packaging sleeves and for the transfer to a transport device.

FIG. 3 shows the transition from the supply (2) to the transport device (4) in an enlarged illustration. In the region of the supply (2), the packaging sleeves (1) are transported in a folded-up state. The packaging sleeves are taken-in by using a transfer element (27) and are transferred to the transport device (4). Unfolding is brought about during the transfer. After the unfolding, sterile gas, preferably tempered air, is firstly applied to the packaging sleeves (1) in the region of the transport device (4). An outflow nozzle (28) is used for this.

Figure 4:
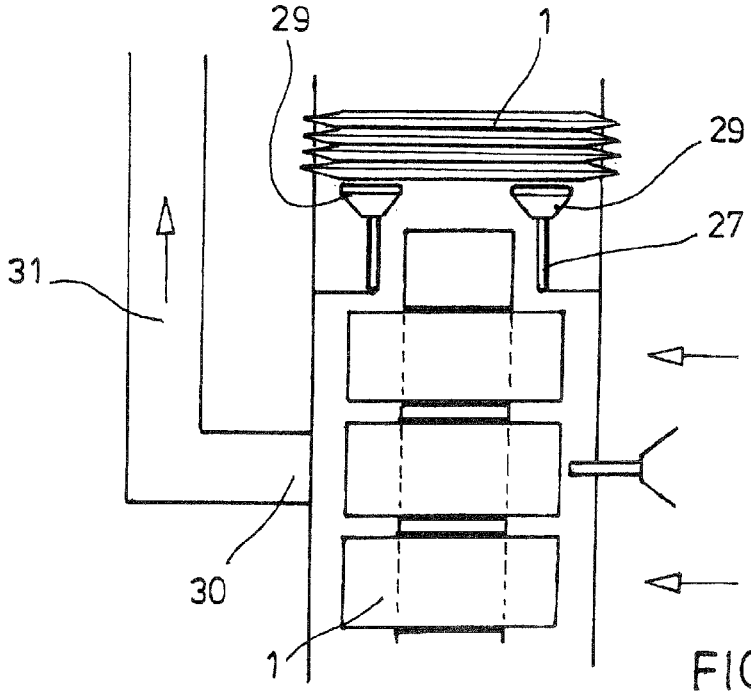
FIG. 4 shows a schematic illustration of the device as per FIG. 3 when viewed from above.

FIG. 4 shows the arrangement as per FIG. 3 in a plan view. Suction-cup-like grippers (29) are visible here in the region of the transfer element (27). The packaging sleeves (1) can be held by for example applying negative pressure. The application using the outflow nozzle (28) can be used for activation or dust removal.

The hot air emitted by the outflow nozzle (28) flows through the packaging sleeve (1) opened on both sides and is supplied to a diversion (31) by a collection device (30).

Figure 5:
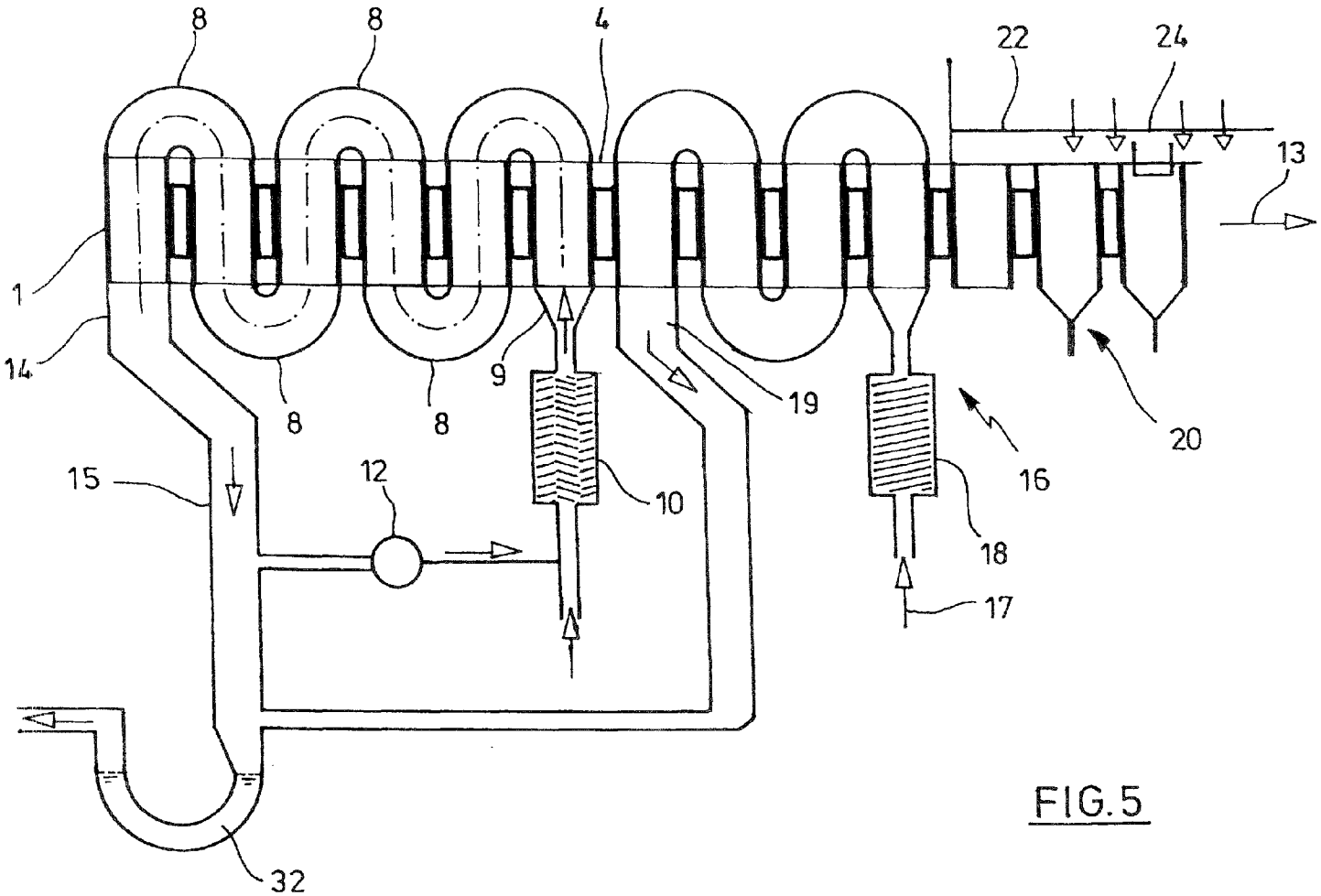
FIG. 5 shows an embodiment modified with respect to FIG. 1 with a return of the disinfectant.

FIG. 5 shows a modification of the embodiment in FIG. 1. However, the supply (9) for the disinfectant is arranged in a central region of the transport device (4). The disinfectant flows through this with a movement component counter to the transport direction (13). The sterile air in the region of the drying device (16) likewise flows with a movement component counter to the transport direction (13) and it is diverted downstream of the supply device (9) in the transport direction (13) with the aid of the collection device (19). The correspondingly diverted sterile air is introduced into the return (15) for the disinfectant and is mixed with hydrogen peroxide at said location. Maintaining predetermined mixture proportions is monitored by the sensor (12). Excess gas is removed from the system via a scrubber (32).

The disinfection station according to the invention is particularly suitable for continuous operation at a high transport velocity. Disinfectant is intensively applied to the individual packaging sleeves (1) and a high disinfection rate is ensured by the multiple through-flows. Adaptations to different formats of the packaging sleeves (1) can be brought about in a simple fashion by positioning the deflections (8).

In the case of fixedly arranged deflections (8), the disinfectant does not flow entirely through the cavities of the packaging sleeves (1), but part flows past the packaging sleeves (1). Since this occurs within the disinfection tunnel (3), such flow guidance is considered advantageous because outer regions of the packaging sleeves (1) are also disinfected.

Figure 6:
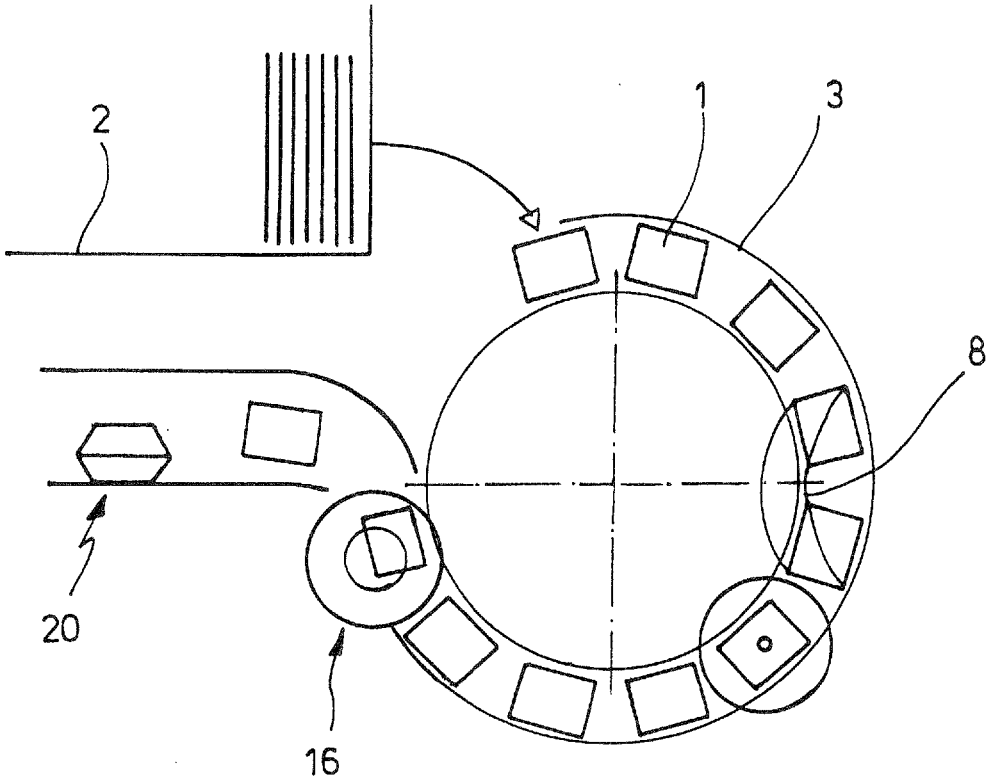
FIG. 6 shows a modified embodiment with a rotating transport wheel.

According to the embodiment in FIG. 6, the packaging sleeves to be disinfected are not transported along a linear transport path, but the packaging sleeves (1) are transferred from the supply (2) to a rotating processing wheel or a rotating processing drum. Otherwise, this results, however, in basically the same functional principle as in the previously explained linear embodiments.

Figure 7:
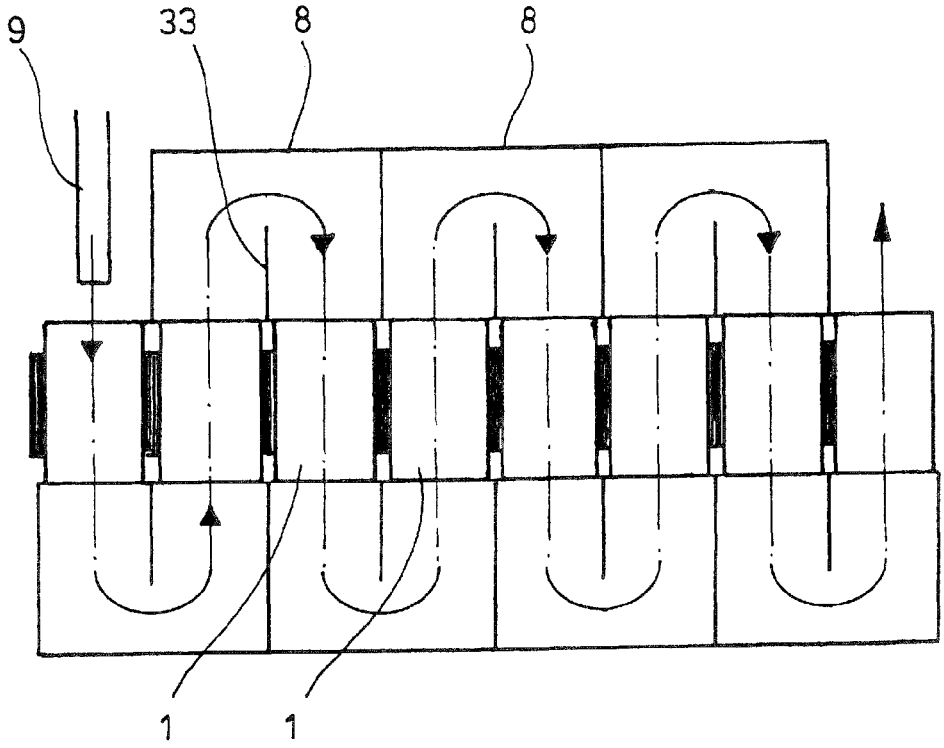
FIG. 7 shows an embodiment modified with respect to FIG. 1 and FIG. 5 with packaging sleeves arranged with relatively small interspaces and FIG. 8 shows an enlarged schematic illustration of a packaging sleeve with an assigned transport element within the disinfection tunnel.

FIG. 7 shows a modified embodiment, in which the packaging sleeves (1) are arranged with only relatively small interspaces. The compactness of the disinfection apparatus is increased as a result of this arrangement. In this embodiment, the deflections (8) can be designed in a box-like fashion and can be provided with a bulkhead plate (33) for guiding the flow. The spacing between the individual packaging sleeves (1) is dimensioned such that sufficient disinfectant can still flow between the packaging sleeves and can bring about the required disinfection or sterilization at said position.

Figure 8:
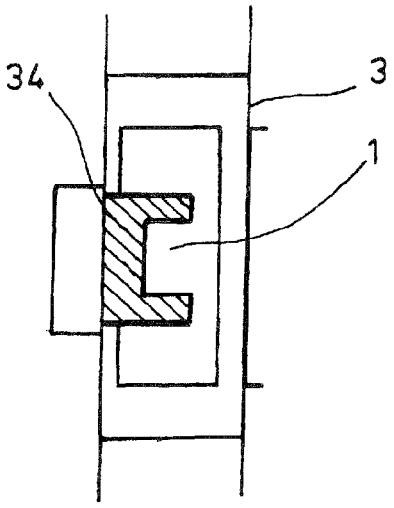

FIG. 7 likewise shows transport elements (34) that bring about an advance of the packaging sleeves within the disinfection apparatus. The transport elements (34) can be designed as pick-up fingers, which are attached to an advance device. More particularly, it is conceived that the spacing between the packaging sleeves (1) to be maintained is predetermined by the transport elements (34). According to the embodiment in FIG. 8, the transport element (34) has a U-shaped configuration.

The invention claimed is:

1. A method for disinfecting packaging formed at least in part as closed packaging sleeves, the method comprising the steps of: transporting the packaging sleeves opened in a longitudinal direction of the sleeve in a region of both ends of the sleeve through a disinfection tunnel, the packaging sleeves being opened at a first end and at a second end opposite the first end; applying disinfectant to the packaging sleeves in the tunnel; and, along the disinfection tunnel, guiding disinfectant flowing out of the opened first end of a first packaging sleeve into the opened second end of a second packaging sleeve different from the first packaging sleeve.

2. The method according to claim 1, including transferring the disinfectant from one packaging sleeve to the adjoining packaging sleeve along a U-shaped flow path.

3. The method according to claim 1, including moving the packaging sleeves past fixedly arranged deflections.

4. The method according to claim 1, including transporting the packaging sleeves continuously.

5. The method according to claim 1, including transporting the packaging sleeves incrementally.

6. The method according to claim 3, wherein the deflections are positioned in the region of the disinfection tunnel such that the deflections can be positioned and/or interchanged.

7. The method according to claim 6, including providing differently dimensioned deflections for different formats of packaging sleeves.

8. The method according to claim 1, including circulating at least part of the disinfectant within a return system.

9. The method according to claim 1, wherein the disinfectant disinfects both an inner and an outer surface of the packaging sleeve.

* * * * *